US009774079B2

(12) United States Patent
Liu

(10) Patent No.: US 9,774,079 B2
(45) Date of Patent: Sep. 26, 2017

(54) CAPACITIVELY-COUPLED ISOLATOR ASSEMBLY

(71) Applicant: Microsoft Corporation, Redmond, WA (US)

(72) Inventor: Luyi Liu, Sammamish, WA (US)

(73) Assignee: Microsoft Technology Licensing, LLC, Redmond, WA (US)

( * ) Notice: Subject to any disclaimer, the term of this patent is extended or adjusted under 35 U.S.C. 154(b) by 250 days.

(21) Appl. No.: 14/248,075

(22) Filed: Apr. 8, 2014

(65) Prior Publication Data

US 2015/0288061 A1 Oct. 8, 2015

(51) Int. Cl.

*H01Q 1/52* (2006.01)
*H01Q 1/48* (2006.01)
*H01Q 1/24* (2006.01)

(52) U.S. Cl.

CPC ..... *H01Q 1/521* (2013.01); *H01Q 1/243* (2013.01); *H01Q 1/48* (2013.01); *H01Q 1/526* (2013.01); *Y10T 29/49018* (2015.01)

(58) Field of Classification Search

USPC ..... 343/700 MS, 702, 745, 836, 841
See application file for complete search history.

(56) References Cited

U.S. PATENT DOCUMENTS 7,352,328 B2 4/2008 Moon et al.
7,629,930 B2 * 12/2009 Murch ..... H01Q 1/48 343/700 MS
8,085,202 B2 12/2011 Ayatollahi et al.
8,723,734 B2 * 5/2014 Chung ..... H01Q 1/243 343/700 MS
2006/0038736 A1 2/2006 Hui et al.
2012/0274522 A1 * 11/2012 Ayatollahi ..... H01Q 1/243 343/745
2012/0274536 A1 11/2012 Pan
2013/0082884 A1 4/2013 Gummalla
2013/0293425 A1 11/2013 Zhu et al.

FOREIGN PATENT DOCUMENTS

CN 102832452 A 12/2012
EP 1566857 A1 8/2005
EP 2256866 A2 1/2010
EP 2518824 A1 10/2012

(Continued)

OTHER PUBLICATIONS

Zhou, et al; "A Dual-Broadband MIMO Antenna System for GSM/UMTS/LTE and WLAN Handsets", IEEE: Antennas and Wireless Propagation Letters, vol. 11, 2012, 4 pages.

(Continued)

*Primary Examiner* — Jessica Han
*Assistant Examiner* — Hai Tran
(74) *Attorney, Agent, or Firm* — Holzer Patel Drennan

(57) ABSTRACT

An isolator assembly includes a capacitively-coupled isolator assembly. In some implementations, the capacitively-coupled isolator element may provide multi-band isolation by having an electrically-floating conductive coupling element with a length that is ½ or ¼ of a carrier wavelength. In other implementations, multiple capacitively-coupled elements may be employed to achieve multi-band isolation.

20 Claims, 6 Drawing Sheets

(56) References Cited

FOREIGN PATENT DOCUMENTS

| | | | |
|---|---|---|---|
| GB | 2500209 | A | 3/2012 |
| WO | 2011087177 | A1 | 7/2011 |

OTHER PUBLICATIONS

International Searching Authority, U.S. Patent and Trademark Office, International Search Report for PCT/US2015/023755, dated Jun. 25, 2015, 5 pages.
International Searching Authority, U.S. Patent and Trademark Office, Written Opinion for PCT/US2015/023755, mailed Jul. 8, 2015, 7 pages.
"International Preliminary Report on Patentability Issued in PCT Application No. PCT/US2015/023755", Mailed Date: Mar. 10, 2016, 6 Pages.
Zeng, et al., "Tetraband Small-Size Printed Strip MIMO Antenna for Mobile Handset Application", In International Journal of Antennas and Propagation, Feb. 12, 2012, 5 pages.
Zhang, et al., "Mutual coupling reduction of two PIFAs with a T—shape slot impedance transformer for MIMO mobile terminals", In IEEE Transactions on Antennas and Propagation, vol. 60, No. 3, Mar. 2012, pp. 1520-1531.
Xing, et al., Design of a Compact Wideband MIMO Antenna for Mobile Terminals, In Progress in Electromagnetics Research, Jul. 2, 2013, pp. 163-174.

* cited by examiner

CAPACITIVELY-COUPLED ISOLATOR ASSEMBLY

SUMMARY

Implementations described and claimed herein may address the foregoing by providing an isolator assembly including a capacitively-coupled isolator assembly. In some implementations, the capacitively-coupled isolator assembly may provide multi-band isolation by having an electrically-floating conductive coupling element with a length that is ½ or ¼ of a carrier wavelength. In other implementations, multiple capacitively-coupled elements may be employed to achieve multi-band isolation.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

Other implementations are also described and recited herein.

DETAILED DESCRIPTION

Fourth generation wireless systems and future successors may employ multiple-input, multiple-output (MIMO) antenna systems. Using MIMO antenna systems, multiple antennas can be used for receiving and transmitting in a radio frequency band to improve communication performance. Furthermore, antenna systems for computing devices present challenges relating to receiving and transmitting radio waves at multiple select frequencies using multiple antennas, for example, when computing devices include antennas to comply with different telecommunications specifications. If not properly spaced from one another, signals from different antennas can interfere with each other through undesirable but strong mutual coupling. This coupling may reduce antenna system performance. As such, small computer electronics, including without limitation laptop computers, tablet computers, mobile phones, and wireless wearable computing systems, impose non-trivial antenna spacing constraints, thereby limiting design options.

An isolator located between antennas may reduce antenna coupling and may permit designs to locate two or more antennas closer to one another without sacrificing antenna performance. The isolators may allow designers greater freedom in overall device design, and may permit multiple antennas to be included in smaller devices.

Figure 1:
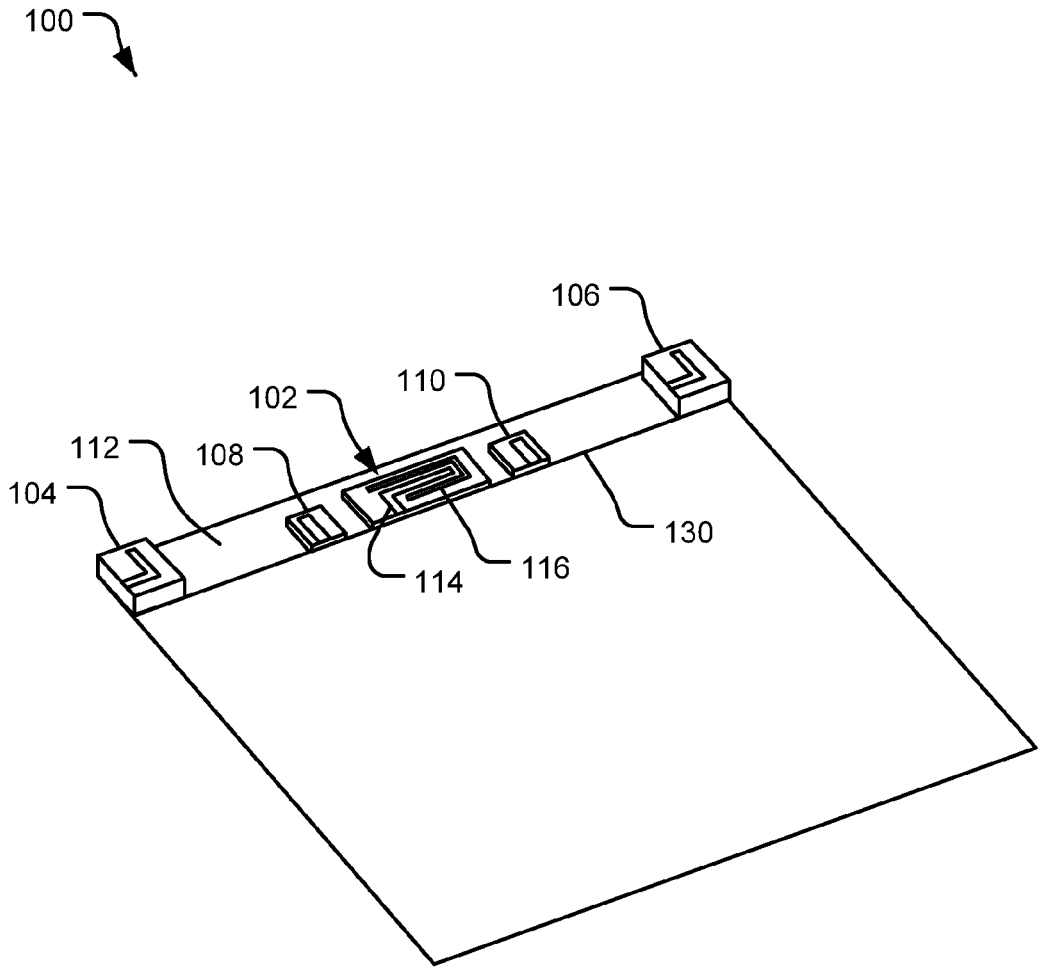
FIG. 1 illustrates an example capacitively-coupled isolator assembly positioned on an electronic device.

FIG. 1 illustrates an example capacitively-coupled isolator assembly 102 positioned on an electronic device 100. The electronic device 100 may be, without limitation, a tablet computer, laptop, mobile phone, personal data assistant, cell phone, smart phone, Blu-Ray player, gaming system, wearable computer, or any other device including wireless communications circuitry.

The electronic device 100 includes a number of antennas (e.g., RF antennas) positioned on both sides of the isolator assembly 102. In particular, the isolator assembly 102 is positioned between a first outer antenna 104 and a second outer antenna 106 and also between a first inner antenna 108 and a second inner antenna 110. Of the antennas shown, at least one antenna operates in a different frequency band than the others. For example, the first inner antenna 108 may operate in a different frequency band than the second inner antenna 110, the first outer antenna 104, and the second outer antenna 106. Alternatively, the electronic device 100 may include two or more "pairs" of identical antennas, with the isolator assembly 102 positioned between the antennas of each pair. This configuration may be used, for example, in MIMO telecommunications systems. Other implementations are disclosed herein and otherwise contemplated.

In one implementation, the first inner antenna 108 and the second inner antenna 110 are substantially identical and operate in a first frequency band, while the first outer antenna 104 and the second outer antenna 106 are substantially identical and operate in a second frequency band. For example, the first inner antenna 108 and the second inner antenna 110 may receive and send radio signals over a wireless local area network. The wireless local area network may be based on the IEEE 801.11 specification, or other industry-standard specification. The IEEE 801.11 (i.e., "WiFi") may operate in two frequency bands, the first being 2400 to 2500 and the second being 5725 to 5875 MHz. In the same or another implementation, the first outer antenna 104 and the second outer antenna 106 receive and send radio signals in a frequency band allocated for cellular transmissions, or approximately 0.7 to 2.7 GHz. These frequency bands may corresponding with communications specifications including, for example, LTE, WiMax, 4G, 3G, 2G, Bluetooth, IEEE 802.11, Near-field communication (NFC), RFID, and others.

The isolator assembly 102 is shown positioned along an edge region of a surface 112, which may be either an inner or an outer surface of the electronic device 100. The surface 112 may be a portion of a front, back, or side face of the electronic device 100. In some implementations, the isolator assembly 102 is positioned in a region other than an edge region of the surface 112.

When an antenna is in use on the surface 112 and is actively receiving or transmitting a signal, a surface current may form on the surface 112. Without effective isolation, the surface current can cause a "coupling" to occur between signals emanated from or received by two or more antennas that operate in the same or an overlapping frequency band. For example, surface current generated by an outgoing transmission of the first inner antenna 108 may "couple to" and thus, interfere with, functionality of the second inner antenna 110. As a result of this coupling, a speed of one or more links may be reduced or system performance may be otherwise hindered.

Antenna coupling can be prevented or reduced by effectively isolating antennas operating in overlapping frequency ranges from one another. Isolation can be achieved via strategic placement of the antennas along the surface 112 or by use of an isolator, such as the isolator assembly 102. To isolate by strategic placement, two antennas operating in an overlapping frequency band are, in one implementation, separated from one another by a certain fraction of the wavelength corresponding to the overlapping frequency band, depending on the isolation needs the RF system. For example the separation distance may be a ¼ wavelength associated with the overlapping frequency band. However, desired separation distances are not always feasible between such antennas in certain industrial designs, particularly in smaller electronic devices with limited surface area. Placement challenges are especially prominent for antennas operating in lower frequencies with longer wavelengths.

The isolator assembly 102 provides isolation that allows for two antennas operating in a first frequency band to be physically separated from one another on the surface 112 by less than ¼ of each of the wavelengths corresponding to the multiple frequency bands. The example isolator assembly 102 illustrated in FIG. 1 includes an "L-shaped" grounding element 114 and a "C-shaped" electrically-floating coupling element 116, which is routed around the two sides of the grounding element 114. In one implementation, the "L-shaped" grounding element has two long sides on a conductive trace routed parallel to an end of a ground plane 130. The grounding element 114 may be electrically connected directly to the ground plane 130, through a shunt component, or via another interconnection element. The coupling element 116 is not connected to ground and is capacitively coupled to the grounding element 114. The length of the coupling element 116 may be set to correspond to a low order, even harmonic of the isolated RF signal frequency (e.g., ¼ or ½ of the RF signal wavelength). Accordingly, signal current along the surface 112 radiates the coupling element 116, which is capacitively coupled to the grounding element 114. In this manner, the signal current from the inner antenna 108 is isolated from the inner antenna 110 and vice versa by the radiating the coupling element 116. Although FIG. 1 illustrates an isolator assembly 102 that isolates in two frequency bands (e.g., at frequencies corresponding to wavelengths two times and four times the length of the coupling element 116), other implementations may provide for isolation in more than two frequency bands.

Figure 2:
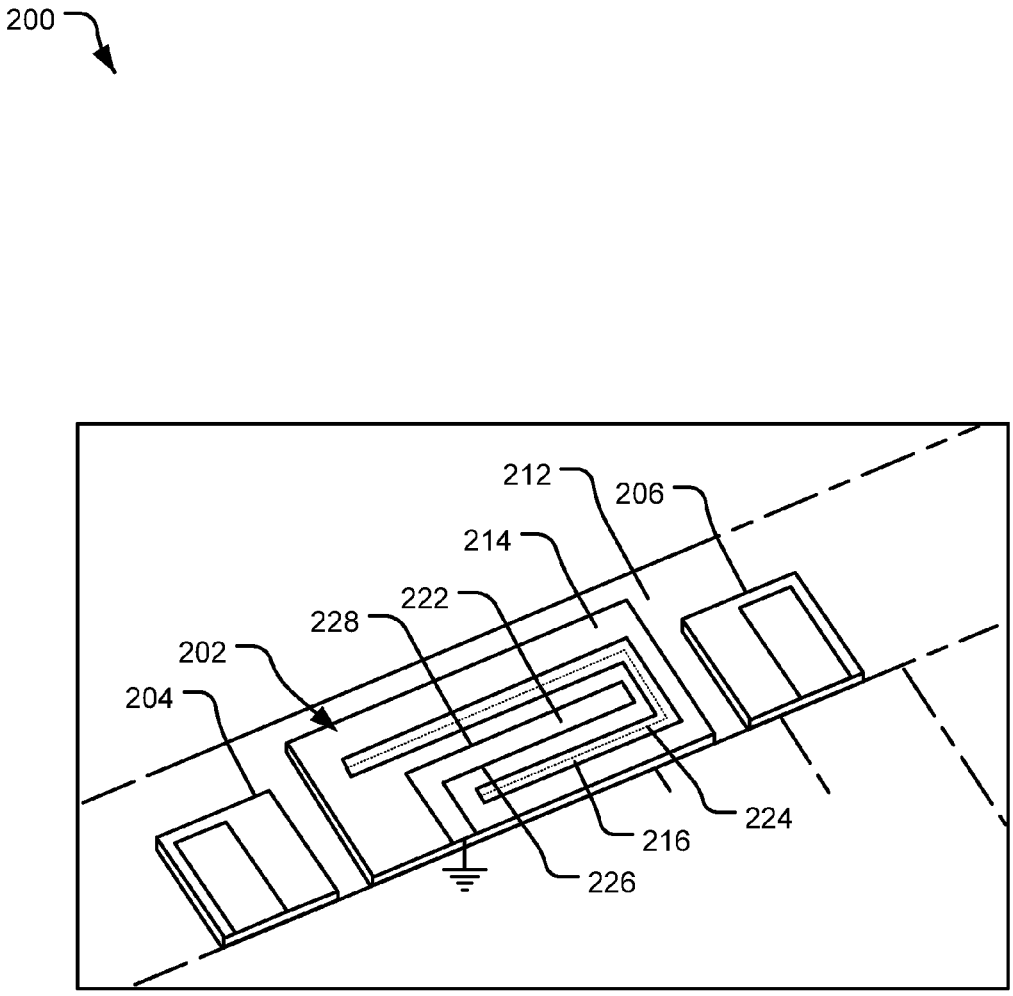
FIG. 2 illustrates an example capacitively-coupled isolator assembly positioned between two antennas on an electronic device.

FIG. 2 illustrates an example capacitively-coupled isolator assembly positioned between two antennas on an electronic device. Although not shown, the surface 212 may include additional antenna elements positioned on one or both sides of the isolator assembly 202. At least one antenna on the surface 212 emanates a radio signal in a first frequency band F1 and at least one antenna on the surface 212 emanates a radio signal in a second frequency band F2, which does not overlap the first frequency band. For example, the antennas 204 and 206 may operate in a WiFi frequency band, while another pair of antennas (not shown) positioned on opposite sides of the isolator assembly may operate in a cellular frequency band. Other implementations are also contemplated.

The isolator assembly 202 includes a grounding element 222 and a coupling element 216 surrounded by an insulating (e.g., dielectric) material 214. The grounding element 222 is a grounded and conductive element. The coupling element 216 is electrically-floating and is excited into a state of resonance by surface current oscillating in either of the frequency bands F1 or F2. The grounding element 222 is shown as "L-shaped"; however, other shapes are also contemplated. The coupling element 216 is shown as "C-shaped"; however, other shapes are also contemplated, including without limitation "L shapes" and meandering routes. In one implementation, the grounding element 222 and the coupling element 216 are components printed on the dielectric medium 214 and mounted to the surface 212.

An end-to-end length (shown by dotted line 224) of the coupling element 216 is associated with the wavelength of a wave having the frequency F1. In one implementation, the coupling element 216 has an end-to-end length 224 that is substantially equal to ¼ of the distance c/F1 and ½ of the distance c/F2, where c is the speed of light. By routing the coupling element 216 along both sides 226 and 228 of the grounding element 222, the coupling element 216 is capacitively coupled to the grounding element 222 along its end-to-end length 224.

In operation, the isolator assembly 202 prevents passage of surface currents with an oscillation frequency in the range of either F1 or F2 as a result of the coupling element 216 resonating at such frequencies. When one or more antennas on the surface 212 are emanating radio signals in the frequency bands F1 or F2, surface current traveling between the antennas 204 and 206 is effectively terminated on the isolation assembly 202. In one example implementation, F1 is a frequency used for 2.4 GHz WiFi band and F2 is a frequency in the 5 GHz WiFi band (also known as the 5.8 GHz WiFi band), although other frequency bands may be isolated in this manner.

Figure 3:
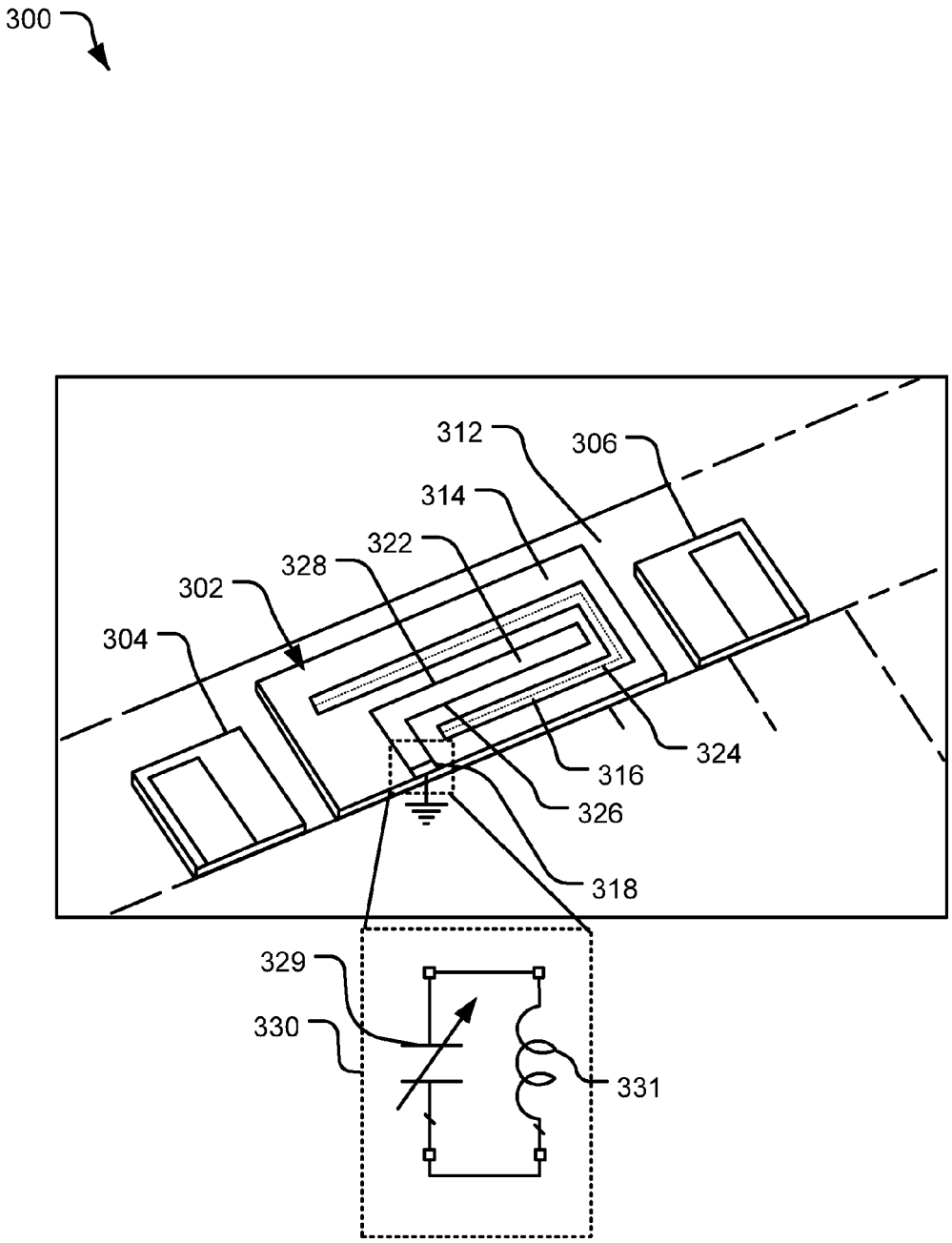
FIG. 3 illustrates an example capacitively-coupled isolator assembly including a shunt component and being positioned between two antennas on an electronic device.

FIG. 3 illustrates an example capacitively-coupled isolator assembly 302 including a shunt element 318 that is positioned between two antennas 304 and 306 on an electronic device. Although not shown, the surface 312 may include additional antenna elements positioned on one or both sides of the isolator assembly 302. At least one antenna on the surface 312 emanates a radio signal in a first frequency band F1 and at least one antenna on the surface 312 emanates a radio signal in a second frequency band F2, which does not overlap the first frequency band. For example, the antennas 304 and 306 may operate in a WiFi frequency band, while another pair of antennas (not shown) positioned on opposite sides of the isolator assembly operate in a cellular frequency band. Other implementations are also contemplated.

The isolator assembly 302 includes a grounding element 322 and a coupling element 316 surrounded by an insulating (e.g., dielectric) material 314. The grounding element 322 is a grounded and conductive element. The coupling element 316 is electrically-floating and is excited into a state of resonance by surface current oscillating in either of the frequency bands F1 or F2. The grounding element 322 is shown as "L-shaped"; however, other shapes are also contemplated. The coupling element 316 is shown as "C-shaped"; however, other shapes are also contemplated, including without limitation "L shapes" and meandering routes. In one implementation, the grounding element 322 and the coupling element 316 are components printed on the dielectric medium 314 and mounted to the surface 312.

An end-to-end length (shown by dotted line 324) of the coupling element 316 is associated with the wavelength of a wave having the frequency F1. In one implementation, the coupling element 316 has an end-to-end length 324 that is substantially equal to ¼ of the distance c/F1 and ½ of the distance c/F2, where c is the speed of light. By routing the coupling element 316 along both sides 326 and 328 of the grounding element 322, the coupling element 316 is capacitively coupled to the grounding element 322 along its end-to-end length 324.

In operation, the isolator assembly 302 prevents passage of surface currents with an oscillation frequency in the range of either F1 or F2 as a result of the coupling element 316 resonating at such frequencies. When one or more antennas on the surface 312 are emanating radio signals in the frequency bands F1 or F2, surface current traveling between the antennas 304 and 306 is effectively terminated on the isolation assembly 302. In one example implementation, F1 is a frequency used for 2.4 GHz WiFi band and F2 is a frequency in the 5 GHz WiFi band, although other frequency bands may be isolated in this manner.

The isolator assembly 302 also includes a shunt circuit 318 that can further tune the isolation frequencies of the isolator assembly 302. In one implementation, the shunt element 318 includes a variable capacitive element 329 (e.g., a voltage-dependent capacitive element) and an inductor 331 (as further illustrated in more detail in exploded view 330). By adjusting capacitance of the variable capacitive element 329, the isolation frequencies can be further refined. The shunt component 318 operates as part of resonance circuit with the grounding element 322 to adjust the electrical length of the coupling element 322. In this manner, the isolator assembly 302 may be varied to provide isolation at different frequencies.

Figure 4:
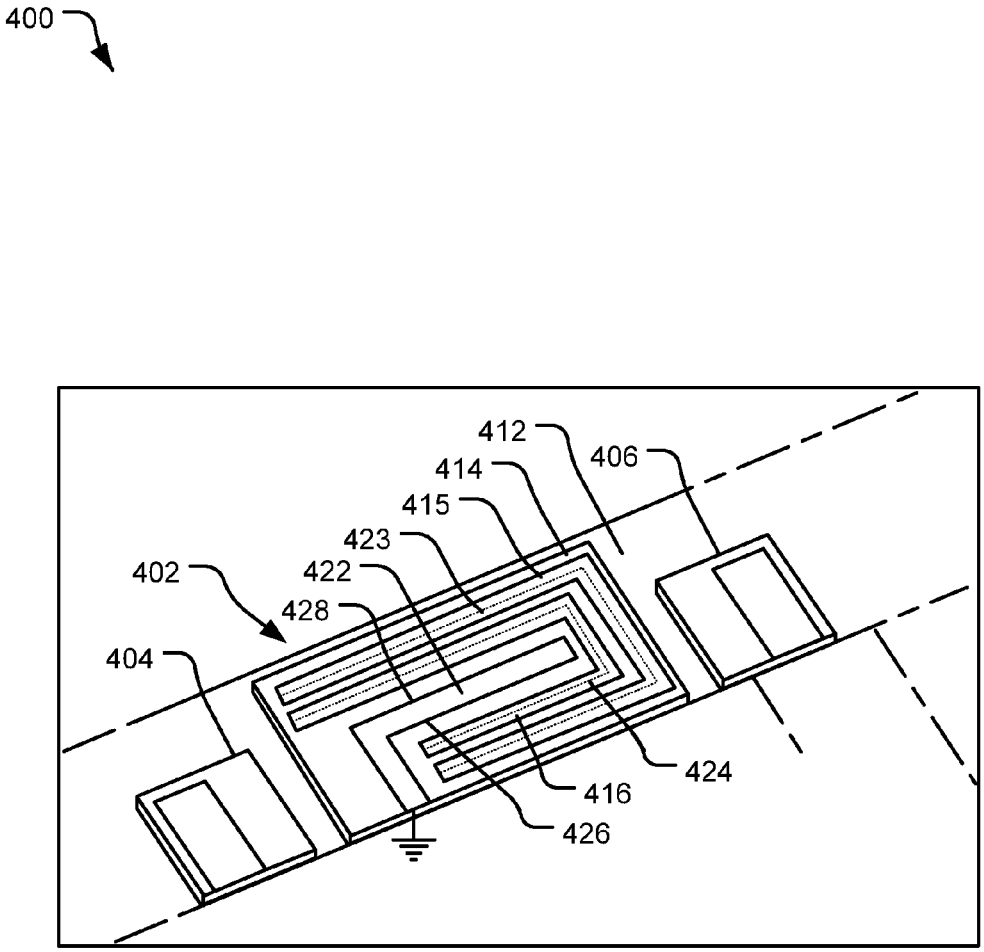
FIG. 4 illustrates an example capacitively-coupled isolator assembly, including multiple coupling components, positioned between two antennas on an electronic device.

FIG. 4 illustrates an example capacitively-coupled isolator assembly 402, including multiple coupling components 415 and 416, positioned between two antennas 404 and 406 on an electronic device. Although not shown, the surface 412 may include additional antenna elements positioned on one or both sides of the isolator assembly 402. At least one antenna on the surface 412 emanates a radio signal in a first frequency band F1 and at least one antenna on the surface 412 emanates a radio signal in a second frequency band F2, which does not overlap the first frequency band. For example, the antennas 404 and 406 may operate in a WiFi frequency band, while another pair of antennas (not shown) positioned on opposite sides of the isolator assembly operate in a cellular frequency band. The same antennas or other antennas on the electronic device may emanate radio signals in frequency bands F3 and F4. Other implementations are also contemplated.

The isolator assembly 402 includes a grounding element 422, a first coupling element 416, and a second coupling element 415 surrounded by an insulating (e.g., dielectric) material 414. The grounding element 422 is a grounded and conductive element. The coupling elements 416 and 415 are electrically-floating. The coupling element 416 is excited into a state of resonance by surface current oscillating in either of the frequency bands F1 or F2, and the coupling element 415 is excited into a state of resonance by surface current oscillating in either of the frequency bands F3 or F4. The grounding element 422 is shown as "L-shaped"; however, other shapes are also contemplated. The coupling elements 416 and 415 are shown as "C-shaped"; however, other shapes are also contemplated, including without limitation "L-shapes" and meandering routes. In one implementation, the grounding element 422 and the coupling elements 416 and 415 are components printed on the dielectric medium 414 and mounted to the surface 412.

An end-to-end length (shown by dotted line 424) of the coupling element 416 is associated with the wavelength of a wave having the frequency F1. In one implementation, the coupling element 416 has an end-to-end length 424 that is substantially equal to ¼ of the distance c/F1 and ½ of the distance c/F2, where c is the speed of light. By routing the coupling element 416 along both sides 426 and 428 of the grounding element 422, the coupling element 416 is capacitively coupled to the grounding element 422 along its end-to-end length 424.

An end-to-end length (shown by dotted line 423) of the coupling element 415 is associated with the wavelength of a wave having a frequency of F1 and a wave having the frequency F2. In one implementation, the coupling element 415 has an end-to-end length 423 that is substantially equal to ¼ of the distance c/F3 and ½ of the distance c/F4, where c is the speed of light. By routing the coupling element 415 along both sides 426 and 428 of the grounding element 422, the coupling element 415 is capacitively coupled to the grounding element 422 along its end-to-end length 423.

In operation, the isolator assembly 402 prevents passage of surface currents with an oscillation frequency in the range of either F1 or F2 as a result of the coupling element 416 resonating at such frequencies and in the range of either F3 or F4 as a result of the coupling element 415 resonating at such frequencies. When one or more antennas on the surface 412 are emanating radio signals in the frequency bands F1 or F2 or frequency bands F3 or F4, surface current traveling between the antennas 404 and 406 is effectively terminated on the isolation assembly 402. In one example implementation, F1 is a frequency in the 2.4 GHz WiFi band and F2 is a frequency in the 5 GHz WiFi band, and F3 and F4 are frequencies used in mobile telecommunications (e.g., LTE, 4G, etc.), although other frequency bands may be isolated in this manner.

Figure 5:
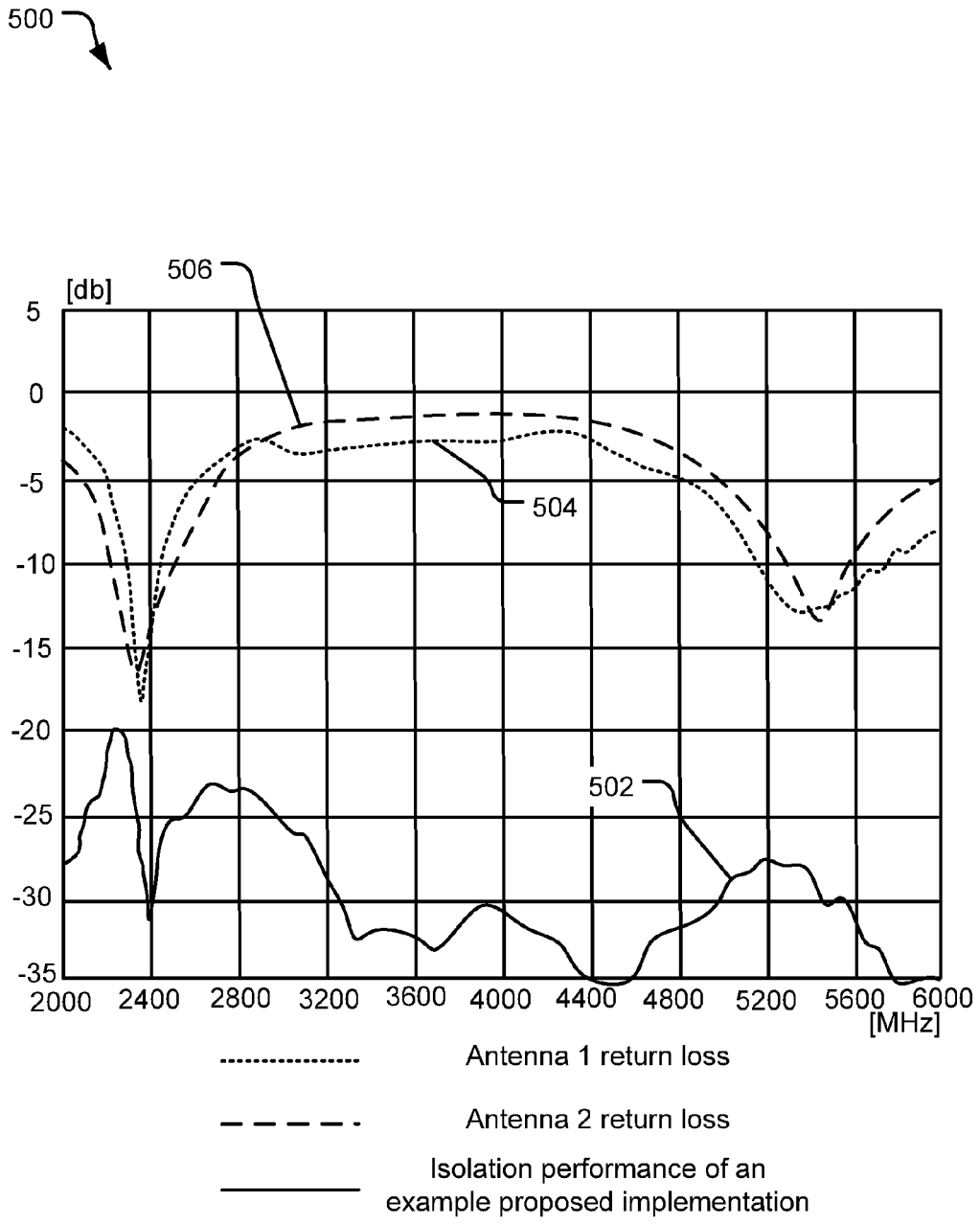
FIG. 5 illustrates plots of isolation performance achieved by an example capacitively-coupled isolator assembly.

FIG. 5 illustrates plots 500 of isolation performance 502 achieved by an example capacitively-coupled isolator assembly, compared to the antenna return losses 504 and 506 of Antenna 1 and Antenna 2, between which the isolator assembly is positioned. As shown, the example capacitively-coupled isolator assembly includes a capacitively-coupled coupling element having a length approximating c/2.4 GHz and c/5 GHz, where c is the speed of light and yields strong isolation in the region of 2.4 GHz and 5 GHz.

Figure 6:
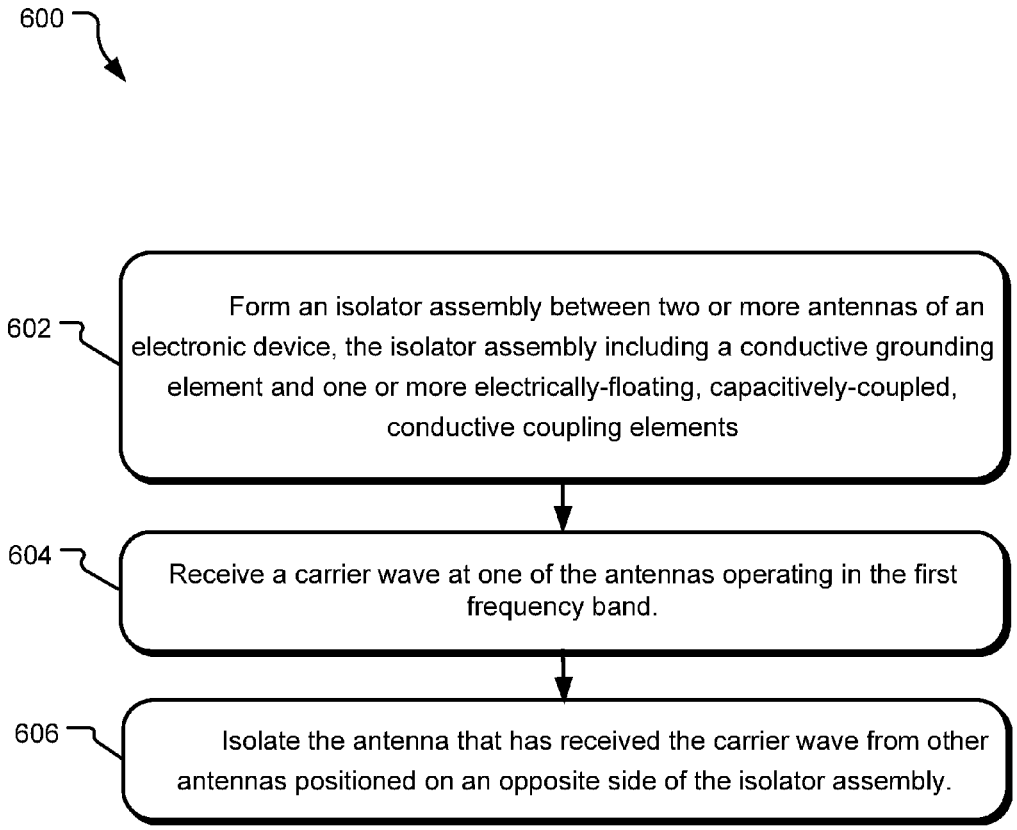
FIG. 6 illustrates example operations for isolating antennas using an example capacitively-coupled isolator assembly.

FIG. 6 illustrates example operations 600 for isolating antennas using an example capacitively-coupled isolator assembly. A forming operation 602 forms an isolator assembly on an electronic device between two or more antennas. The isolator assembly is configured to resonate in a first frequency band and a second frequency band and includes at least one conductive grounding element. In one implementation, the isolator assembly also includes a single electrically-floating, capacitively-coupled, conductive coupling element that resonates in two or more frequency bands based on its length approximating ½ and ¼ of the wavelengths of such frequency bands. In another implementation, the isolator assembly includes multiple electrically-floating, capacitively-coupled, conductive coupling elements.

A receiving operation 604 receives, at one or more antennas, a carrier wave oscillating in a first frequency band. Responsive to the receiving operation 604, a surface current with an oscillation frequency in the first frequency band forms on the electronic device.

An isolation operation 606 isolates the antenna that received the carrier wave from any antennas positioned on the opposite side of the isolator assembly. In particular, the isolation operation 606 is performed by an electrically-floating, capacitively-coupled, conductive coupling element that resonates at in the first frequency band. The same process may be operative for one or more additional frequency bands, as previously described. Other implementations are also contemplated.

The implementations of the invention described herein are implemented as logical steps in one or more computer systems. The logical operations of the present invention are implemented (1) as a sequence of processor-implemented steps executing in one or more computer systems and (2) as interconnected machine or circuit modules within one or more computer systems. The implementation is a matter of choice, dependent on the performance requirements of the computer system implementing the invention. Accordingly, the logical operations making up the embodiments of the invention described herein are referred to variously as operations, steps, objects, or modules. Furthermore, it should be understood that logical operations may be performed in any order, adding and omitting as desired, unless explicitly claimed otherwise or a specific order is inherently necessitated by the claim language.

The above specification, examples, and data provide a complete description of the structure and use of exemplary implementations. Since many implementations can be made without departing from the spirit and scope of the claimed invention, the claims hereinafter appended define the invention. Furthermore, structural features of the different examples may be combined in yet another implementation without departing from the recited claims.

What is claimed is:

1. Apparatus comprising:

a capacitively-coupled isolator assembly positioned between at least two antennas, the capacitively-coupled isolator assembly providing isolation between the at least two antennas and further including:

a grounded conductive element electrically connected to a ground plane electrically connected to the at least two antennas; and an electrically-floating conductive coupling element capacitively coupled to the grounded conductive element.

2. The apparatus of claim 1, wherein the electrically-floating conductive coupling element is surrounded by an insulating material.

3. The apparatus of claim 2, wherein the grounded conductive element has a first long side and a second long side and the electrically-floating conductive coupling element is capacitively-coupled to both long sides of the grounded conductive element.

4. The apparatus of claim 3, the electrically-floating conductive coupling element extends along both long sides of the grounded conductive element.

5. The apparatus of claim 1, wherein the electrically-floating conductive coupling element has a length of ¼ of a wavelength of a carrier wave signal radiated by the at least two antennas.

6. The apparatus of claim 1, wherein the electrically-floating conductive coupling element has a length of ½ of a wavelength of a carrier wave signal radiated by the at least two antennas.

7. The apparatus of claim 1, wherein the isolator assembly includes one or more tunable capacitors to adaptively tune a mode of resonance of the isolator assembly.

8. The apparatus of claim 1, wherein the electrically-floating conductive coupling element is a first electrically-floating conductive coupling element, the apparatus further comprising:

a second electrically-floating conductive coupling element capacitively coupled to the grounded conductive element, the second electrically-floating conductive coupling element having a different end-to-end length than the first electrically-floating conductive coupling element.

9. The apparatus of claim 1, wherein the electrically-floating conductive coupling element is a first electrically-floating conductive coupling element and further comprising:

a second electrically-floating conductive coupling element capacitively coupled to the grounded conductive element, the first electrically-floating conductive coupling element being routed between the grounded conductive element and the second electrically-floating conductive coupling element.

10. A method comprising:

positioning a capacitively-coupled isolator assembly between at least two antennas, the capacitively-coupled isolator assembly providing isolation between the at least two antennas electrically connected to a ground plane, wherein the capacitively-coupled isolator assembly includes a grounded conductive element electrically connected to the ground plane and an electrically-floating conductive coupling element capacitively coupled to the grounded conductive element.

11. The method of claim 10 wherein the electrically-floating conductive coupling element is surrounded by an insulating material.

12. The method of claim 11, wherein the grounded conductive element has a first long side and a second long side and the electrically-floating conductive coupling element is capacitively-coupled to both long sides of the grounded conductive element.

13. The method of claim 12, the electrically-floating conductive coupling element extends along both long sides of the grounded conductive element.

14. The method of claim 10, wherein the electrically-floating conductive coupling element has a length of ¼ of a wavelength of a carrier wave signal radiated by the at least two antennas.

15. The method of claim 10, wherein the electrically-floating conductive coupling element has a length of ½ of a wavelength of a carrier wave signal radiated by the at least two antennas.

16. The method of claim 10 further comprising:

adaptively tuning a mode of resonance of the isolator assembly using one or more tunable capacitors.

17. The method of claim 10, wherein the electrically-floating conductive coupling element is a first electrically-floating conductive coupling element and is routed between the grounded conductive element and a second electrically-floating conductive coupling element capacitively coupled to the grounded conductive element, the second electrically-floating conductive coupling element having a different end-to-end length than the first electrically-floating conductive coupling element.

18. The method of claim 10, wherein the electrically-floating conductive coupling element is a first electrically-floating conductive coupling element and is routed between the grounded conductive element and a second electrically-floating conductive coupling element capacitively coupled to the grounded conductive element.

19. A computing device comprising:

at least two antennas;

a capacitively-coupled isolator assembly positioned between the at least two antennas, the at least two antennas are electrically connected by a ground plane, the capacitively-coupled isolator assembly providing isolation between the at least two antennas and including a grounded conductive element electrically connected to the ground plane, a first electrically-floating conductive coupling element capacitively coupled to the grounded conductive element, and a second electrically-floating conductive coupling element capacitively coupled to the grounded conductive element, the second electrically-floating conductive coupling element having a different end-to-end length than the first electrically-floating conductive coupling element.

20. The computing device of claim 19, wherein the first electrically-floating conductive coupling element is routed between the grounded conductive element and the second electrically-floating conductive coupling element.

* * * * *